US008408962B2

(12) United States Patent
Sambenedetto

(10) Patent No.: US 8,408,962 B2
(45) Date of Patent: Apr. 2, 2013

(54) TOY CONSTRUCTION SYSTEM HAVING A VARIABLE ANGLE JOINT

(76) Inventor: Melissa C. Sambenedetto, Niceville, FL (US)

( * ) Notice: Subject to any disclaimer, the term of this patent is extended or adjusted under 35 U.S.C. 154(b) by 590 days.

(21) Appl. No.: 11/446,778

(22) Filed: Jun. 5, 2006

(65) Prior Publication Data

US 2007/0281580 A1 Dec. 6, 2007

(51) Int. Cl.
*A63H 33/04* (2006.01)

(52) U.S. Cl. ..... 446/85; 446/102

(58) Field of Classification Search ..... 446/85, 446/102, 108, 115, 116, 118, 120–124, 128
See application file for complete search history.

(56) References Cited

U.S. PATENT DOCUMENTS

| | | | | | |
|---|---|---|---|---|---|
| 1,446,868 | A * | 2/1923 | Baker | 446/126 |
| 1,608,592 | A * | 11/1926 | Funk | 446/126 |
| 1,746,839 | A * | 2/1930 | Main et al. | 446/100 |
| 2,609,638 | A * | 9/1952 | Lindenmeyer | 446/126 |
| 2,662,335 | A * | 12/1953 | Calverley | 446/99 |
| 3,987,579 | A * | 10/1976 | Palenik, III | 446/118 |
| 4,738,648 | A * | 4/1988 | Berndt | 446/120 |
| 5,310,376 | A * | 5/1994 | Mayuzumi et al. | 446/107 |
| 5,690,446 | A * | 11/1997 | Poissant et al. | 403/361 |
| 5,752,869 | A * | 5/1998 | Huff | 446/104 |
| 5,769,681 | A * | 6/1998 | Greenwood, Sr. et al. | 446/120 |
| 5,897,417 | A * | 4/1999 | Grey | 446/125 |
| 6,264,522 | B1 * | 7/2001 | Dickson | 446/120 |
| 6,572,429 | B2 * | 6/2003 | Cheung | 446/120 |
| 8,087,970 | B2 * | 1/2012 | Sambenedetto | 446/102 |
| 2007/0178799 | A1 * | 8/2007 | Rudell et al. | 446/120 |

* cited by examiner

*Primary Examiner* — Gene Kim
*Assistant Examiner* — Alyssa Hylinski
(74) *Attorney, Agent, or Firm* — Stites & Harbison, PLLC; Juan Carlos A. Marquez, Esq.

(57) ABSTRACT

A toy construction system is disclosed that includes at least one panel member having a multiplicity of female twist-lock connectors formed in a surface thereof. A multiplicity of female socket flexible connectors are included where each has a stem adapted with threads for receipt by the female twist-lock connectors. Also, an equal multiplicity of ball connectors is included wherein each has a stem adapted with threads for receipt by the female twist-lock connectors. Another plurality of blocks of various sizes and shapes is included wherein each has a plurality of female connectors formed in surfaces thereof. Accordingly, a structure may be made by attaching the blocks to the panel by attaching the ball connectors to the block and the female connectors to the panel and engaging the ball connectors to the female socket flexible connectors.

6 Claims, 10 Drawing Sheets

TOY CONSTRUCTION SYSTEM HAVING A VARIABLE ANGLE JOINT

CROSS REFERENCE TO RELATED APPLICATION

This Patent Application relates to co-pending applications Ser. No. 11/446/776, entitled TOY CONSTRUCTION SYSTEM HAVING A ROTATABLE CONNECTOR JOINT, filed the same date hereof, and Ser. No. 11/446/777, entitled TOY CONSTRUCTION SYSTEM HAVING A COMPOUND CONNECTOR, filed the same date hereof, both by the same inventor hereof.

FIELD OF THE INVENTION

The present invention generally relates to the field of toy building systems and more particularly to an improved system including a joint fixable at a wide variety of angles, thereby enabling the construction of a wide assortment of children's toys and projects.

BACKGROUND OF THE INVENTION

A variety of toy construction systems are available in the market today and described in numerous issued U.S. Patents. Such construction systems commonly have male and female interlocking joints for connecting the various elements together. Although a group of such construction elements can generally be interconnected in a variety of ways, such systems generally have a limitation of the connectors not readily locking in certain orientations, or becoming worn over time, thereby becoming incapable of holding a position at a desired angle.

Exemplary prior art includes U.S. Pat. No. 409,744, entitled TOY BUILDING BLOCKS, which issued Aug. 27, 1889, to A. F. C. Garben. The invention disclosed in this patent relates to building blocks designed for the amusement and instruction of children. The invention includes sphere-headed coupling blocks, which provide a universal joint between pairs of recessed blocks. The result is that any two recessed blocks may be connected in line on a curve or at any angle, and may be held together with sufficient rigidity to make any desired toy structure. A large problem with this invention is that over time the sphere-headed couplings become worn and the objects created will not hold their shape.

Another relevant prior art toy construction system is disclosed in U.S. Pat. Nos. 1,915,835 and 1,916,634, both entitled TOY CONSTRUCTION BLOCK, both of which issued to C. H. PAJEAU on Jun. 27, 1933 and Jul. 4, 1933, respectively. These patents disclose the original "Tinker Toy" building block system, which includes an assortment of relatively inter-fitting elements of varying types that are adapted to be manually assembled into structures and mechanisms of widely varying sizes and types. This invention is somewhat limited in what may be built with the elements.

Still another example of the prior art is disclosed in U.S. Pat. No. 2,622,335, entitled SECTIONAL TOY FIGURE, which issued Dec. 15, 1953 to G. H. Calverley, The disclosed invention relates to sectional toy figures having inter-engagable construction pieces including bodies, heads, limbs, feet and connecting elements. The joints include a socket in the body piece for interconnection with similarly connecting elements. A key problem with this invention is the same as discussed above. Wear on the elements will cause the pieces not to hold their shape.

Yet another prior art example is disclosed in U.S. Pat. No. 3,286,391, entitled CONSTRUCTION TOY HAVING A VARIABLE ANGLE JOINT, which issued to M. Mengeringhausen on Nov. 22, 1966. This patent discloses another joint mechanism for use with toy construction. The invention includes a relatively small spherical connecting member of elastic material having a plurality of substantially cylindrical holes. Again, a key problem with this invention is the same as discussed above. Wear on the elements will cause the pieces not to hold their shape.

Another example of the prior art is disclosed in U.S. Pat. No. 3,458,949, entitled CONSTRUCTION SET, which issued to G. G. Young on Aug. 5, 1969. This patent discloses a terminal unit of spherical shape including a pair of like interlocking members, each having a plurality of circumferential grooves in it. The side walls of each groove, intermediate the ends of the groove, have transversely opposite cavities which form a ball receiving socket. The construction set disclosed in this patent is somewhat limited in what may be constructed.

Many other examples of the prior art are illustrated in issued such U.S. Patents as U.S. Pat. No. 3,510,979, entitled ASSEMBLY KIT, which issued May 12, 1970 to A. Fischer; U.S. Pat. No. 3,747,261, entitled BALL AND ROD LINKAGE FOR JOINING POLYHEDRAL MEMBERS, which issued Jul. 24, 1973 to Nast Salem; U.S. Pat. No. 4,037,978, entitled RESILIENT SWIVEL CONNECTOR, which issued Jul. 26, 1977 to Brian W. Connelly; U.S. Pat. No. 4,078,328, entitled CONSTRUCTION TOY SET, which issued Mar. 14, 1978 to Larry W. Rayment; U.S. Pat. No. 5,897,417, entitled CONSTRUCTION SYSTEM, which issued Apr. 27, 1999 to Michael J. Grey; and, U.S. Pat. No. 6,264,522 B1, entitled CONSTRUCTION SYSTEM, which issued Jul. 24, 2001 to Marilyn M. Dickson.

What is needed is a toy construction system that allows the interconnection of a large variety of components in a large variety of structures or formations in order to foster child development of dexterity and creativity.

SUMMARY OF THE INVENTION

As will be amplified in greater detail hereinbelow, the present invention solves one of the prior art problems by providing a connector joint that is fixable at a wide variety of angles.

Accordingly, it is an object of the present invention to provide a toy construction system that will foster child development of dexterity and creativity.

Another object of the present invention is to provide a toy construction system capable of assembling a wide variety of structures or formations.

Yet another object of the present invention is to provide a toy construction system with a flexible joint element fixable at a wide variety of angles.

These and other objects, which will become apparent as the invention is described in detail below, wherein a toy construction system is provided that includes at least one panel member having a multiplicity of female twist-lock connectors formed in one surface thereof. A multiplicity of female socket flexible connectors are included where each has a stem adapted with threads for receipt by the female twist-lock connectors. Also, an equal multiplicity of ball connectors is included wherein each has a stem adapted with threads for receipt by the female twist-lock connectors. Another plurality of blocks of various sizes and shapes is included wherein each has a plurality of female connectors formed in surfaces thereof. Accordingly, a structure may be made by attaching the blocks to the panel by attaching the ball connectors to the block and the female connectors to the panel and engaging the ball connectors to the female socket flexible connectors.

Still other objects, features and advantages of the present invention will become readily apparent to those skilled in the art from the following detailed description, wherein is shown and described only the preferred embodiment of the invention, simply by way of illustration of the best mode contemplated of carrying out the invention. As will be realized, the invention is capable of other and different embodiments, and its several details are capable of modifications in various obvious respects, all without departing from the invention. Accordingly, the drawings and description are to be regarded as illustrative in nature, and not as restrictive, and what is intended to be protected by Letters Patent is set forth in the appended claims. The present invention will become apparent when taken in conjunction with the following description and attached drawings, wherein like characters indicate like parts, and which drawings form a part of this application.

DETAILED DESCRIPTION OF ONE EMBODIMENT

Figure 1:
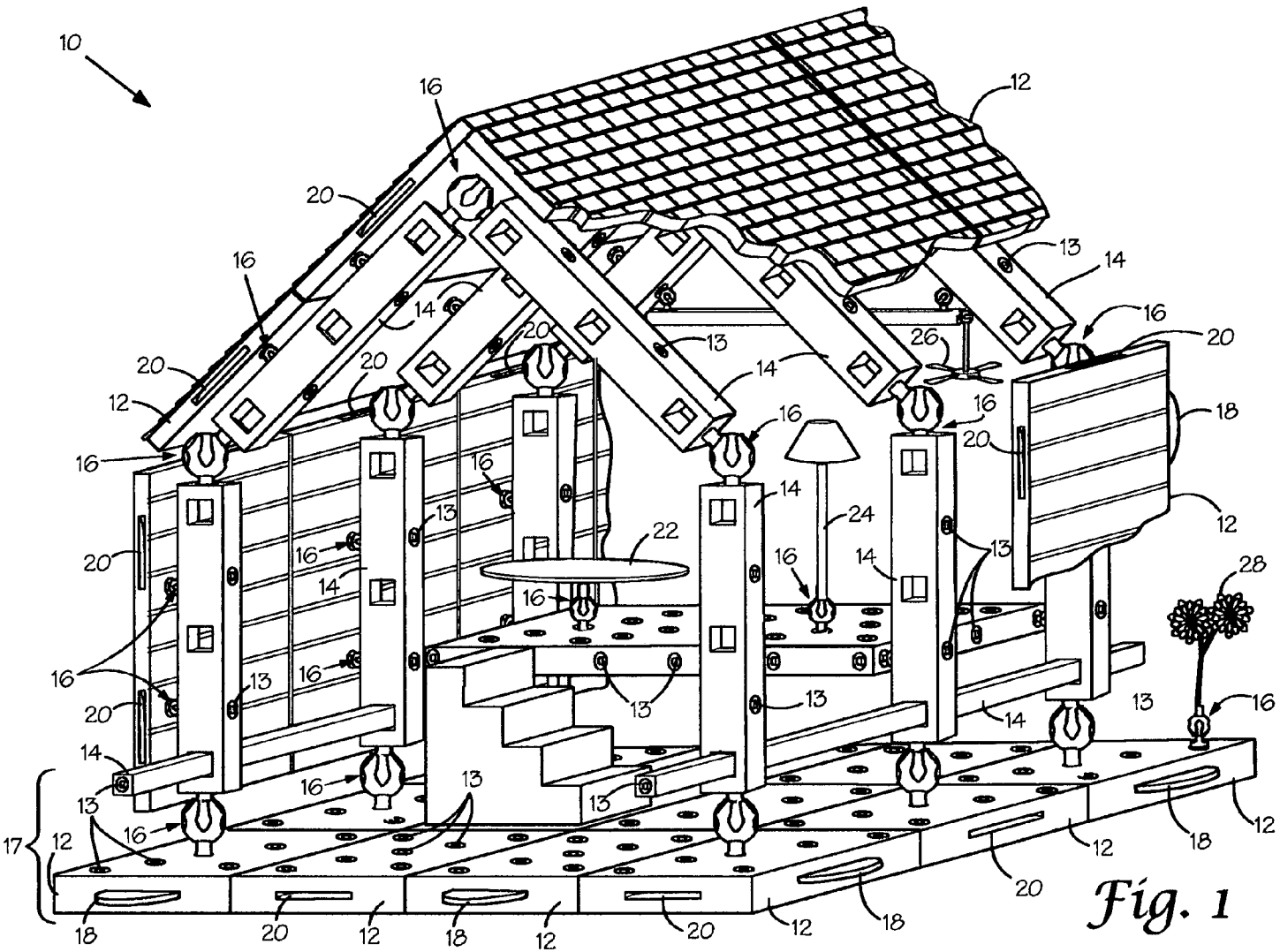
FIG. 1 is a perspective view of a play house assembled with the novel elements of the present invention.

Referring now to the drawings and to FIG. 1 in particular, a perspective view of a play house 10 assembled with the novel construction elements of the present invention is shown. The play house 10 may be assembled from a plurality of panels 12, which may include a textured side (e.g., roof shingles or clap-board siding) and an opposite side having a plurality of connector holes 13, which will be explained in greater detail hereinbelow. The structure, including the roof panels 12 are held together with a plurality of blocks 14, each being connected at either end by novel ball connectors 16 in accordance with the present invention.

The play house 10 is constructed on a base platform 17 made up of a multiplicity of panels 12, which may be interlocked by the use of biscuits 18 inserted into slots 20. It is noted that alternatively the biscuits 18 may be fused into an edge of a panel 12 during the manufacture of the toy construction system. This would be preferred if the system were to be used by toddlers who might swallow small parts. A table 22, a lamp 24 and a fan 26 are examples of design elements that may form a part of the toy construction system of the present invention. Also, a design element such as an imitation shrub 28 may be attached to the base platform as well. Each of the design elements just mentioned may be attached to the structure by the use of ball and socket connectors 16, which will be amplified further hereinafter. It is noted that the design elements may also be attached to the structure via twist-lock connectors.

Figure 2A:
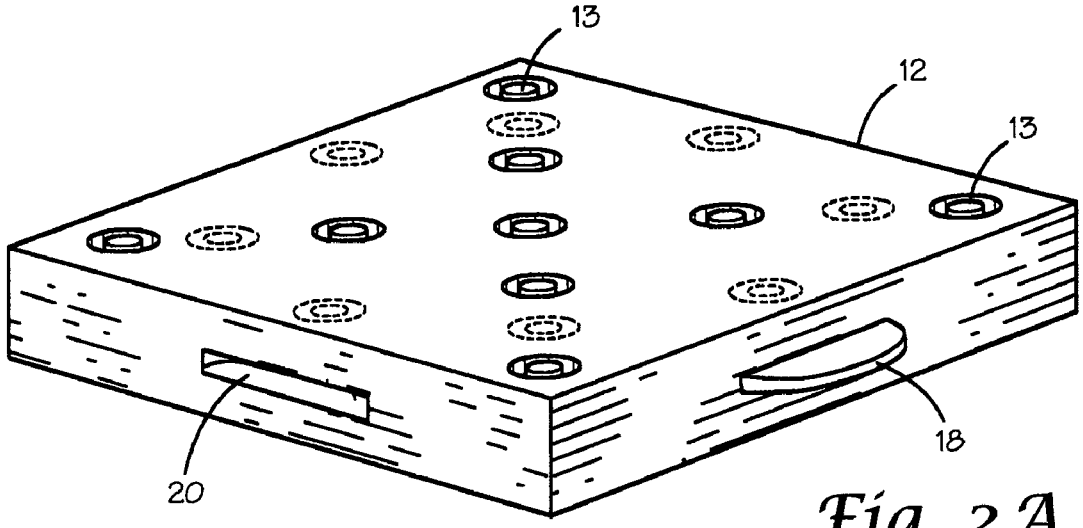
FIGS. 2A and 2B are perspective views of a typical panel useful in the practice of the present invention.
Figure 2B:
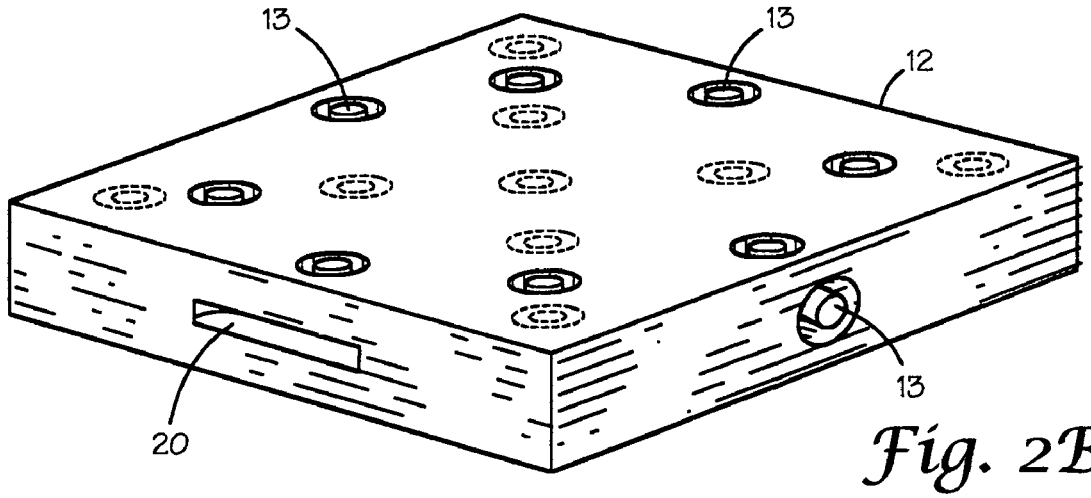

Referring now to FIGS. 2A and 2B, a pair of panels 12 are shown in perspective view. The panel 12 shown in FIG. 2A includes along opposing edges thereof biscuits 18, and along the remaining two edges slots 20 for receiving biscuits of an adjacent panel. On the surface shown of the panel 12 (in both FIGS. 2A and 2B) a multiplicity of connector holes 13 are formed and configured in accordance with the present invention for receiving twist lock pins, which will be amplified hereinafter. It is noted that connector holes 13 may be formed anywhere on a panel 12 (or on any other part of the system components as well) as illustrated along an edge of the panel 12 shown in FIG. 2B.

Figure 2C:
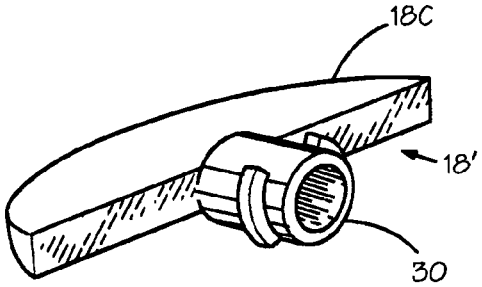
FIGS. 2C through 2G illustrate details of a variety of connectors useful in the practice of the present invention.
Figure 2D:
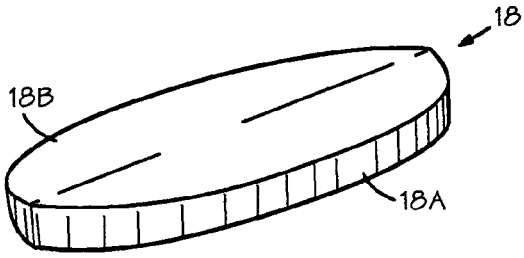
Figure 2E:
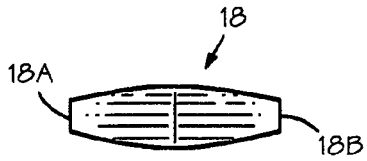

Turning now to FIGS. 2C through 2G, details of a variety of connectors useful in the practice of the present invention are shown. FIGS. 2D and 2E illustrate a typical biscuit 18 wherein the sides 18A and 18B are each shaped to be received by the slot 20. FIG. 2C illustrates an alternate type of biscuit 18', wherein one side 18C is shaped in the conventional manner (FIG. 2D) and a second side is shaped into a twist lock pin 30 for receipt by one of the connector holes 13.

Figure 2F:
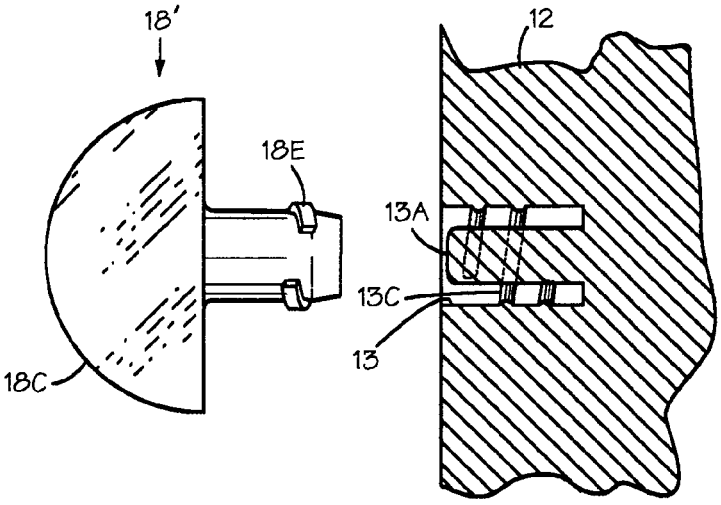
Figure 2G:
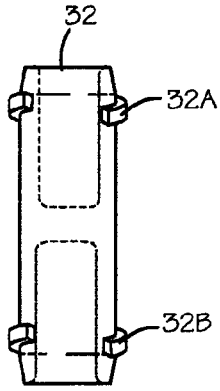

With reference to FIG. 2F, details of the twist lock pin 30 are shown. The connector hole 13 is formed with a central core 13A. Also, threads 13C are formed in the slotted connector hole so as to receive mating threads 18E of the biscuit 18'. All of the connector holes 13 shown in the various views are constructed in the same manner as that shown in FIG. 2F and are of the same diameter. FIG. 2G illustrates a threaded connecting pin 32 having threads 32A on one end and threads 328 on the opposite end thereof.

Figure 3A:
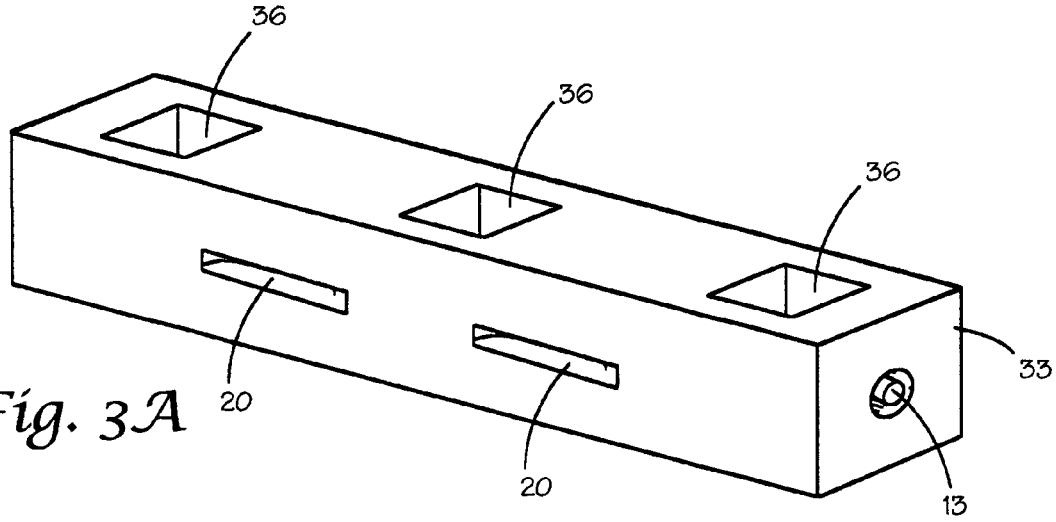
FIGS. 3A through 3C illustrate details of a variety of blocks useful in the practice of the present invention.
Figure 3B:
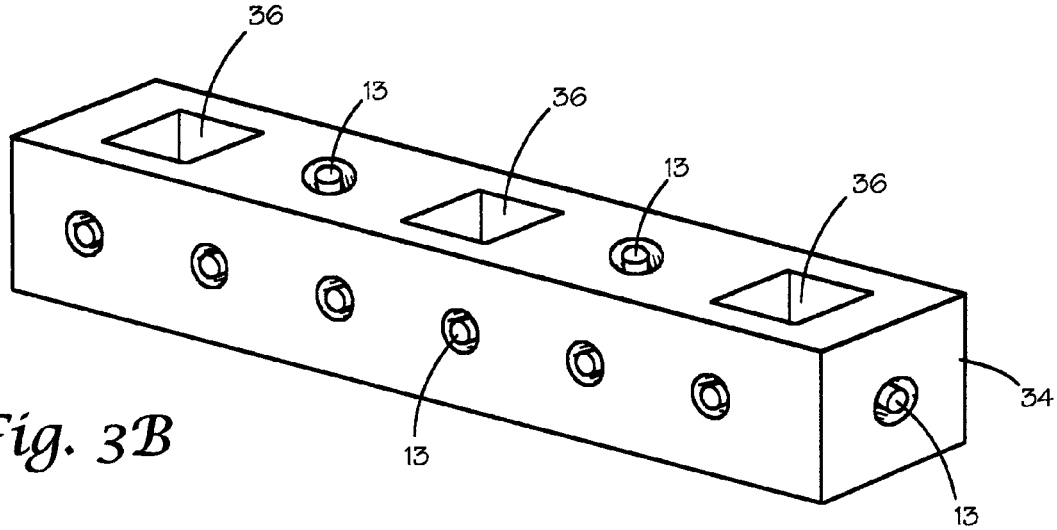
Figure 3C:
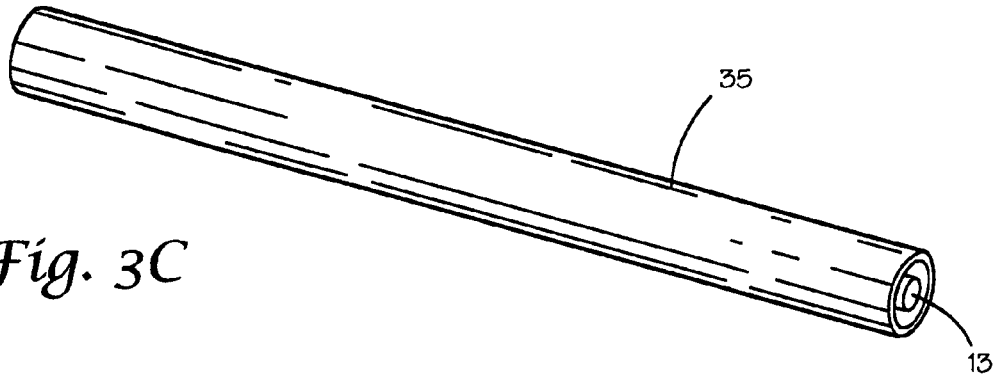

Referring now to FIGS. 3A, 3B and 3C, details are shown of a variety of blocks 33, 34 and 35, respectfully, which are useful in the practice of the present invention. The block 33 shown in FIG. 3A is square in cross section and contains openings 36 formed therethrough. The block 33 may also be rectangular in cross section or any other preferred shape. The openings or holes 36 may be of any shape or size and may be formed in any number, or any location of the system blocks and panels. A circular connector hole 13 may be formed in an end of the block 33. Along a side of the block 33 slots 20 are formed and adapted to receive biscuits (FIG. 2D, e.g.), which slots may be formed in any number or any location of the system components.

The block 34 shown in FIG. 3B is similar to the block 33. However, connector holes 13 are added to the top and along a side in lieu of the slots 20. A third block variation is shown in FIG. 3C, wherein the block 35 is circular in cross section. A connector hole 13 is formed in an end thereof.

Figure 4A:
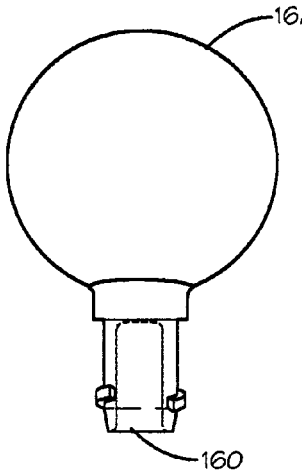
FIGS. 4A through 4F illustrate details of a variety of ball connectors useful in the practice of the present invention.
Figure 4B:
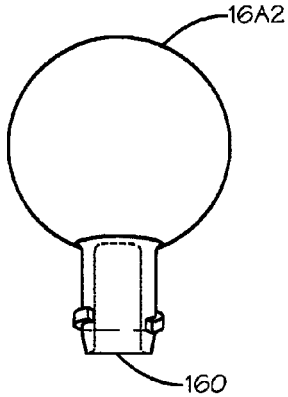
Figure 4C:
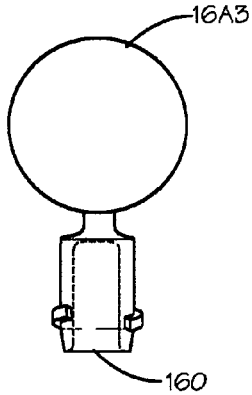
Figure 4D:
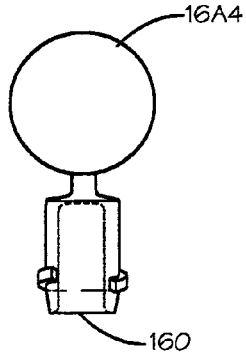
Figure 4E:
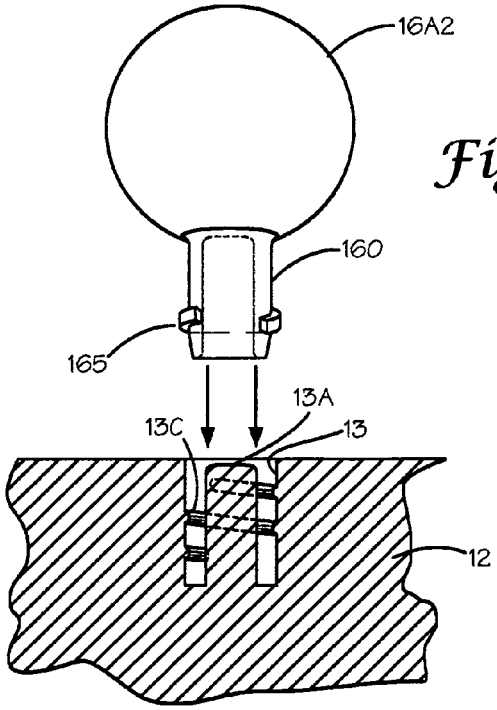
Figure 4F:
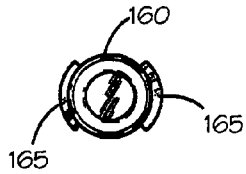

Referring now to FIGS. 4A through 4F, details of a variety of ball connectors 16A1 through 16A4 are shown, which are useful in the practice of the present invention. Note that the connector shaft 160 of each of the balls is of the same diameter. This enables standardization of the size of the connector holes 13, but allowing for a variation in the size of the balls connected thereto. FIG. 4E illustrates the shaft 160 with threads 165 in alignment with the connector hole 13. Note also, the hole 13 has a threaded shaft 13C for receiving the threads 165. FIG. 4F is an end view of the shaft 160 showing the threads 165 extending therefrom. It is noted that the balls may be fused onto select pieces in select locations of the toy construction system components by the manufacturer in lieu of making them all separate parts. It is noted that the ball receptacle 30 (or sockets 40) are preferably sized to correspond to the same size balls illustrated in FIGS. 4A through 4D and described hereinabove.

Figure 5A:
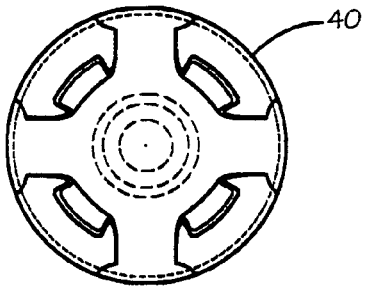
FIGS. 5A through 5D illustrate details of the novel ball-receptacle of the present invention, where in combination with the afore-mentioned ball connectors are useful in assembling joints with a wide variety of angles.
Figure 5B:
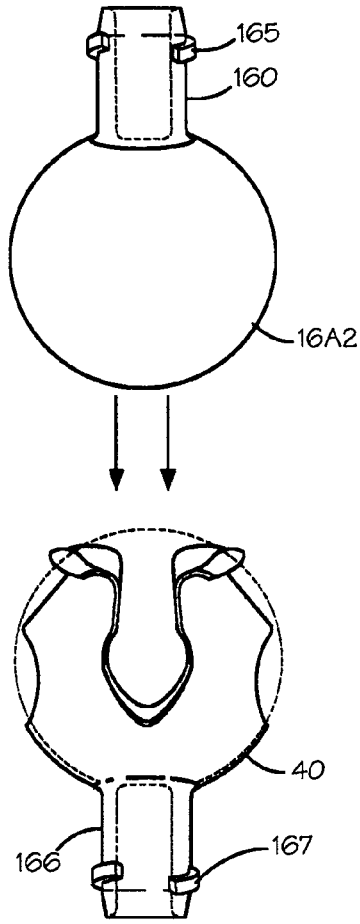
Figure 5C:
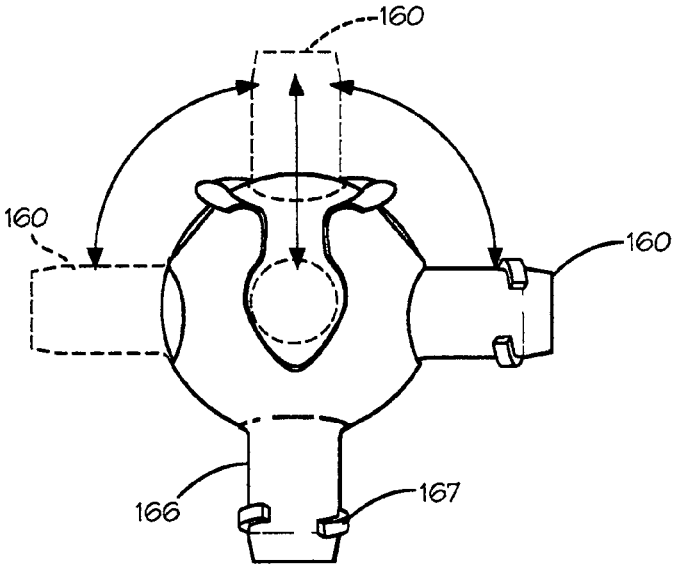
Figure 5D:
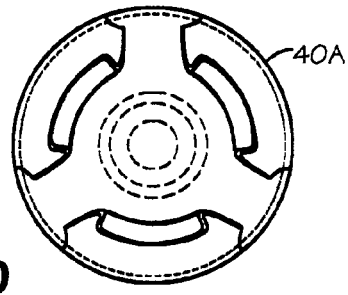

With reference to FIGS. 5A through 5D, details of the novel ball-receptacle 40 of the present invention is shown, which is useful in the practice of the present invention. The ball-receptacle 40 is preferably made of flexible, yet resilient, material such as any type of plastic having memory characteristics. The top view of FIG. 5A shows the connector 40 with four leaves, while the top view of FIG. 5D shows an alternate connector 40A with three leaves. FIG. 5B illustrates the manner in which the ball connector 16A2 is inserted into the ball-receptacle 40.

With reference to FIG. 5C, the ball connector 16A2, while inserted into the receptacle 40, may be rotated into five fixed positions. That is, the first fixed position is straight up, or with the shaft 160 extending from the top opening of the ball-receptacle 40 as illustrated by dashed lines 160'. The shaft 160 may be rotated forward to extend out of the page as shown by dashed line 160", or it may be rotated left (line 160'" or the right (solid line 106""). Also, the shaft may be rotated to a fifth position (not shown) away from the viewer. Note also that the ball-receptacle 40 has its own shaft 166, which is of the same size and shape as the shaft 160. Moreover, the shaft 166 includes threads 167 in the same manner as threads 165. The ball may also rotate or turn within the socket a complete 360° back and forth thus allowing the holes in the blocks to line up for placement of dowels to support a structure. Moreover, it is noted that the ball connectors 40 may be fused onto select pieces at select locations of the toy construction system components by the manufacturer in lieu of making them all separate parts.

Figure 6:
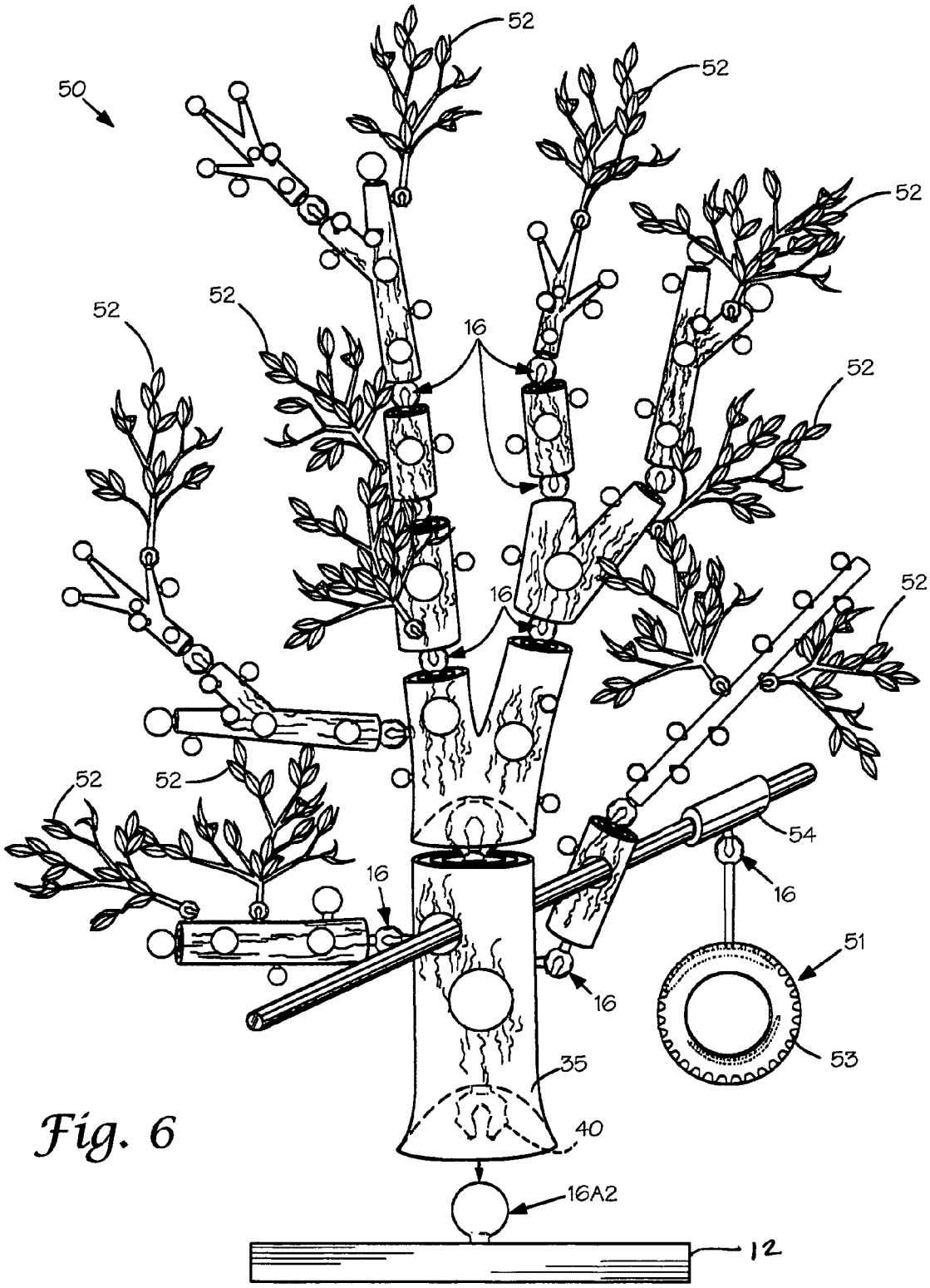
FIG. 6 is a perspective view of a fantasy tree and play apparatus assembled with the novel design elements of the present invention.

Referring now to FIG. 6, a perspective view of a fantasy tree 50 and play apparatus 51 assembled with the novel elements of the present invention is shown. The tree 50 is first assembled on a panel 12, which functions as a base plate for the structure. Varying diameter blocks, similar to the circular diameter block 35, are interconnected by means of connectors 16 to form the trunk and branches of the tree 50. The block 35 may be textured to simulate bark. An individual design element, such as a simulated tire 53, may be secured to one of the blocks 35 by means of a slip ring 54 and a ball connector 16. It is noted that several of the smaller pieces, such as the branches 52 may be fused onto larger blocks 35 by the manufacturer in lieu of making them all separate components.

Figure 7A:
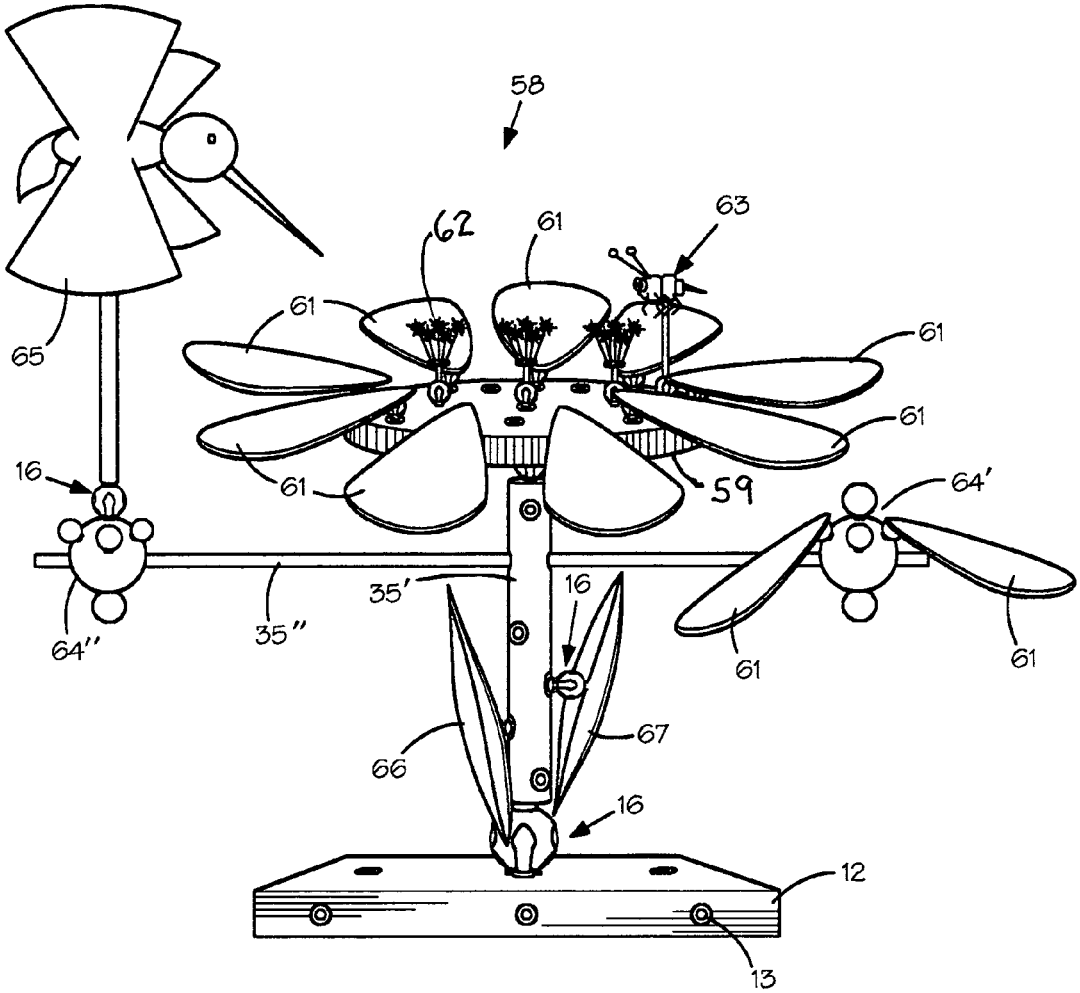
FIGS. 7A and 7B illustrate a variety of projects assembled with the novel elements of the present invention.
Figure 7B:
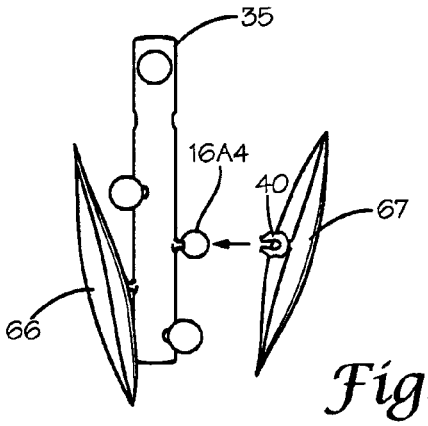

With reference to FIGS. 7A, another fantasy project is shown wherein a variety of design elements are used. A fantasy flower 58 is shown coupled to the base plate 12 and to a vertical standing block 35'. The fantasy flower 58 includes a disk 59 with a multiplicity of petals 61 and flower buds 62 attached thereto. A fantasy insect 63 may be added to the fantasy flower as well. A horizontal block 35" may be inserted into an opening in the block 35', which may support a fantasy bee 64 and a fantasy hummingbird 65. The design elements 64 and 65 are secured to the block 35" by means of openings in sphere shaped blocks 64' and 64", respectively, then the blocks 64' and 64" are secured by means of the ball connectors 16 as described hereinabove. Also, fantasy leaves 66 and 67 may be added to the block 35' by means the same type of ball connectors 16, as described hereinabove.

FIGS. 8A through 8E and FIGS. 9A through 9D illustrate a variety of possible play elements that may be used in conjunction with the toy construction system of the present invention and further adds to the theme and aesthetic value of the toy construction system. The design elements shown in 8A through 8E all have a ball receptacle 40 for connection to structures, while the design elements shown in FIGS. 9A through 9D have a ball connector (such as connector 16A4) for connection to structures. All elements in FIGS. 8A-8E and FIGS. 9A-9D may have ball receptacles or ball connectors. That is, there is no restriction on the use of one form of connector over another. Though not preferred, they may also have twist-lock connectors.

Figure 8A:
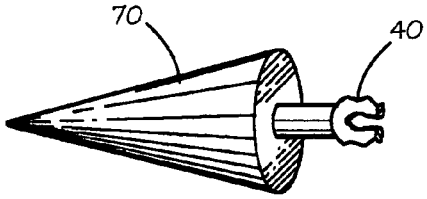
FIGS. 8A through BE illustrate further details of design elements useful in the practice of the present invention.
Figure 8B:
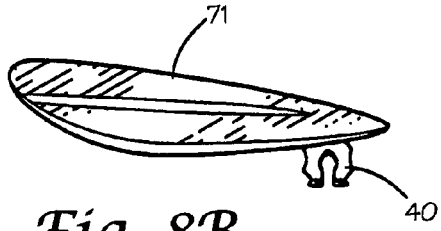
Figure 8C:
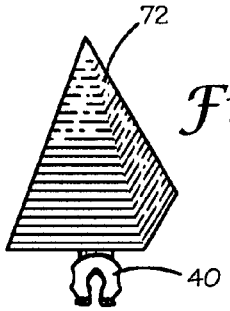
Figure 8D:
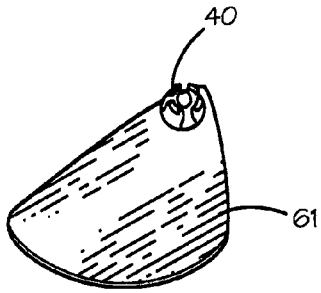
Figure 8E:
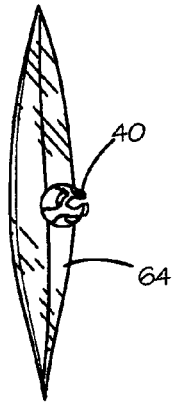

FIG. 8A illustrates a conical design element 70, while FIG. 8B illustrates a leaf design element 71. FIG. 8C illustrates a pyramid design element 72 while FIG. 8D illustrates a flower petal; and, FIG. 8E illustrates a leaf design element 64. The shapes shown herein are by means of illustration only and not meant to be limiting or restrictive in any sense. Moreover, these shapes are meant to be generic and may be used for any object the user so desires. That is, when these shapes (or parts) are placed strategically on other components they may represent to the user something obvious or recognizable.

Figure 9A:
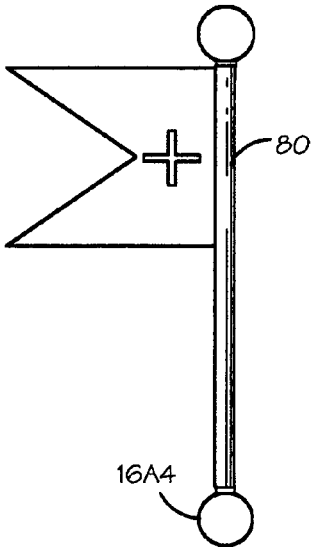
FIGS. 9A through 9D illustrate additional design elements useful in the practice of the present invention.
Figure 9B:
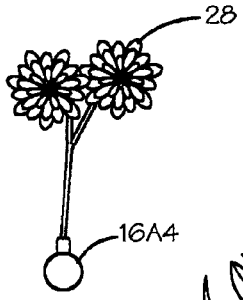
Figure 9C:
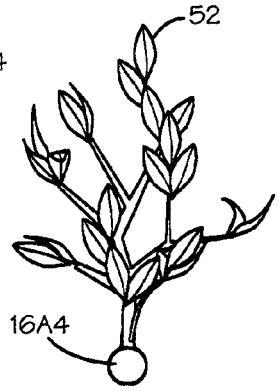
Figure 9D:
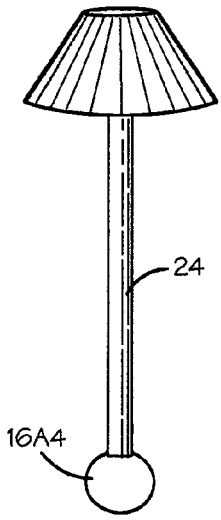

FIG. 9A illustrates a flag standard design element 80, while FIG. 9B illustrates the flower bloom design element 28. FIG. 9C illustrates the tree branch 52 design element, while FIG. 9D illustrates the lamp stand 24. The shapes (or components) shown in FIGS. 9A-9D represent something recognizable in and of itself. For example, a lamp, a tree branch or flag and flag pole. The elements illustrated in FIGS. 9A-9D are by means of illustration only and are not intended to be limiting or restrictive in any way.

Figure 10:
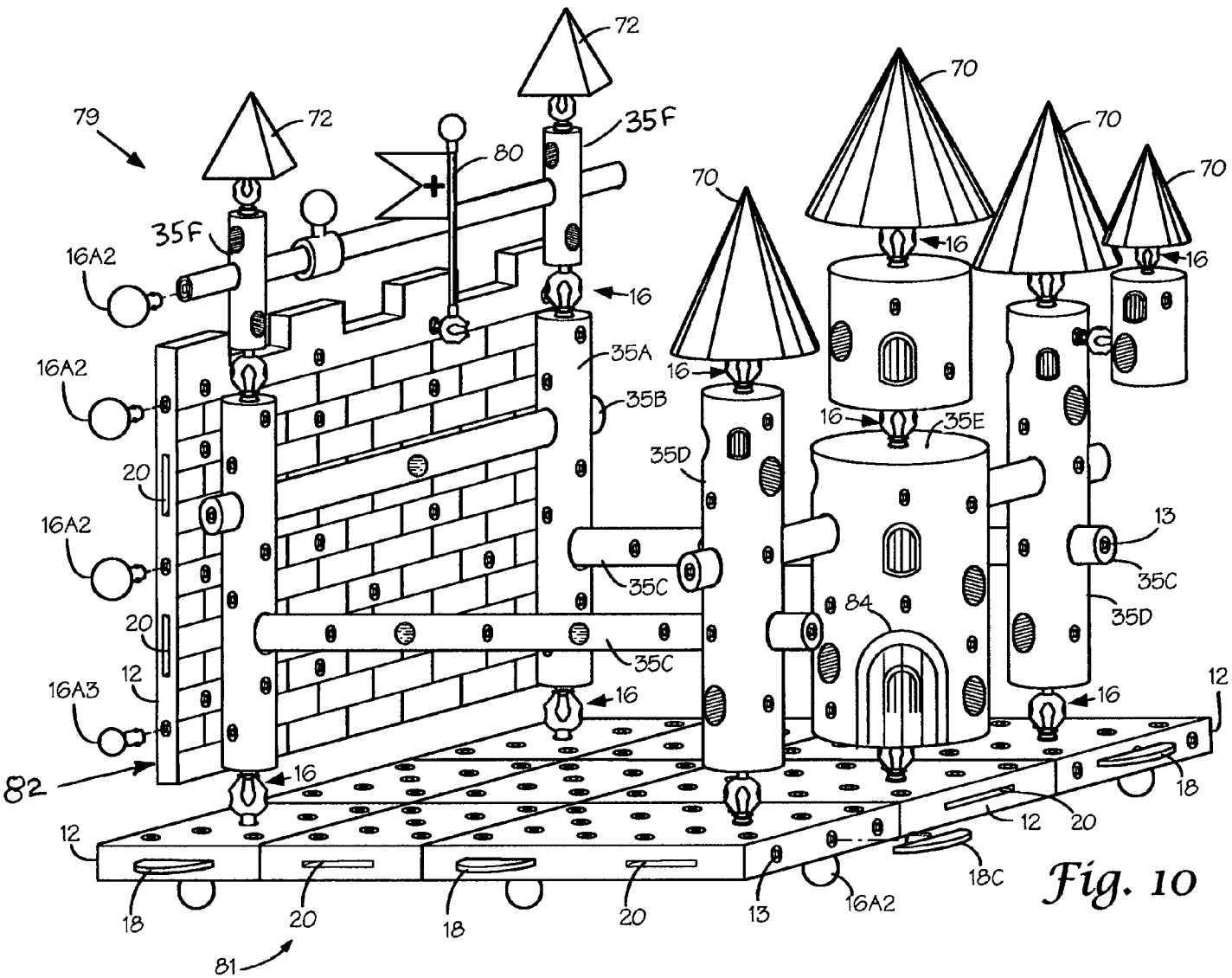
FIG. 10 is a perspective view of a castle that may be assembled with the novel elements of the present invention.

FIG. 10 illustrates a castle 79 that may be constructed with the elements of the system of the present invention. The starting element is a multiplicity of panels 12, which are connected as described hereinabove, so as to form a base plate 81. Moreover, a multiplicity of panels 12 may form a wall of the castle. Vertical standing blocks 35A may be used to hold up the wall 82, which blocks are secured to both the base plate 81 and the wall 82 by means of the above-described flexible connectors 16. Horizontal blocks 35B connect the vertical blocks 35A. The flag standard 80 is attached to the top of the wall 82 by a ball connector 16, which is connected to the ball receptacle of a flexible connector which is then connected to the wall itself via a twist-lock connector.

Additional horizontal blocks 35C connect the blocks 35A with truncated vertical blocks 35D. A fantasized castle entrance 84 may be formed in another truncated vertical block 35E. Pyramid design elements may adorn the tops of the vertical blocks 35F, which are extensions of the vertical blocks 35A by means of the ball connectors 16. Conical design elements 70 may adorn the tops of the blocks 35D and 35E by means of the same ball connectors 16.

An alternate embodiment of the present invention a manufacturer may fuse a male/male twist-lock connector, such as that shown in FIG. 2G, onto a block or other element of the toy construction system, which would make the system easier to use by a toddler.

Although the invention has been described with reference to a specific embodiment, this description is not meant to be construed in a limiting sense. Various modifications of the disclosed embodiment as well as alternative embodiments of the invention will become apparent to one skilled in the art upon reference to the description of the invention. It is therefore contemplated that the appended claims will cover any such modifications of embodiments that fall within the true scope of the invention.

What is claimed is:

1. A toy construction system, comprising:

a member having a number of female twist-lock connectors formed in a surface thereof;

a number of socket connectors each having a tulip-shaped female socket made of a plastic material having a memory characteristic, each having a socket connector shaft having a mating thread for reversible receipt by one of said female twist-lock connectors, said socket connectors having at least three leaves with a space between each adjacent leaf;

a number of ball connectors, each having a ball connector shaft having a mating thread for receipt by one of said female twist-lock connectors, and each of said ball connectors being of a size for reversible receipt by a socket connector, said ball connector shaft having at least a portion having a diameter adapted to fit into said space, said space allowing for reversibly locking said ball connector shaft at an angle with respect to said socket connector shaft;

a plurality of said number of female twist-lock connectors having a connector hole with a central core, said connector hole having a groove adapted to receive said mating thread of a socket connector shaft or of a ball connector shaft;

a plurality of said socket connector shafts and of said ball connector shafts having an opening and an internal passage configured to reversibly receive at least a portion of said central core.

2. The system of claim 1 wherein said member is a panel member comprising along one edge thereof a biscuit extension and along another edge thereof a slot for receiving said biscuit of another panel so that a number of panels may be joined together to form surfaces for construction of a variety of projects with said system.

3. The system of claim 1 wherein said socket connectors include three spaced-apart leaves for receiving said ball connectors and configured to provide a range of movement between 0 and 90 degrees of said ball connector shaft with respect to said socket connector shaft of said socket connectors.

4. The system of claim 3 wherein said spaces are disposed to receive the ball connector shaft in a position of 90 degrees of rotation of said ball connector shaft with respect to said socket connector shaft.

5. The system of claim 1 wherein said socket connectors include four spaced-apart leaves for receiving said ball connectors and configured to provide a range of movement between 0 and 90 degrees of said ball connector shaft with respect to said socket connector shaft.

6. The system of claim 1 wherein said socket connector includes four spaced-apart leaves for receiving said ball connector and configured to provide a range of movement between 0 and 90 degrees of said ball connector shaft with respect to said socket connector shaft and said spaces are disposed to receive the ball connector shaft in a position of 90 degrees of rotation of said ball connector with respect to said socket connector shaft, thereby allowing the reversible locking of said ball connector shaft at a position relative to said socket connector shaft of 90 degrees of rotation with respect to said socket connector shaft, as well as allowing the ball connector shaft to be placed in line with the socket connector shaft at 0 degrees of rotation such that the socket connector shaft and ball connector shaft are 180 degrees in line.

* * * * *

UNITED STATES PATENT AND TRADEMARK OFFICE

CERTIFICATE OF CORRECTION

PATENT NO. : 8,408,962 B2
APPLICATION NO. : 11/446778
DATED : April 2, 2013
INVENTOR(S) : Sambenedetto It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 716 days.

Signed and Sealed this
Twenty-seventh Day of January, 2015

Michelle K. Lee

Michelle K. Lee
*Deputy Director of the United States Patent and Trademark Office*